US010490366B2

(12) United States Patent
Mori et al.

(10) Patent No.: US 10,490,366 B2
(45) Date of Patent: Nov. 26, 2019

(54) POWER SWITCHING CONTROL DEVICE

(71) Applicant: MITSUBISHI ELECTRIC CORPORATION, Tokyo (JP)

(72) Inventors: Tomohito Mori, Tokyo (JP); Aya Yamamoto, Tokyo (JP); Daisuke Yoshida, Tokyo (JP)

(73) Assignee: MITSUBISHI ELECTRIC CORPORATION, Chiyoda-ku, Tokyo (JP)

( * ) Notice: Subject to any disclaimer, the term of this patent is extended or adjusted under 35 U.S.C. 154(b) by 0 days.

(21) Appl. No.: 15/778,957

(22) PCT Filed: Dec. 9, 2015

(86) PCT No.: PCT/JP2015/084481
§ 371 (c)(1),
(2) Date: May 24, 2018

(87) PCT Pub. No.: WO2017/098594
PCT Pub. Date: Jun. 15, 2017

(65) Prior Publication Data

US 2018/0358189 A1 Dec. 13, 2018

(51) Int. Cl.
*H01H 35/00* (2006.01)
*H01H 47/00* (2006.01)
(Continued)

(52) U.S. Cl.
CPC ..... *H01H 9/563* (2013.01); *H01H 9/56* (2013.01); *H01H 33/59* (2013.01); *H01H 33/593* (2013.01); *H01H 33/16* (2013.01)

(58) Field of Classification Search
CPC ..... H01H 33/59; H01H 33/593; H01H 9/56; H01H 9/563; H01H 33/16
(Continued)

(56) References Cited

U.S. PATENT DOCUMENTS 6,392,390 B1 5/2002 Ito et al.
6,433,980 B1 8/2002 Tsutada et al.
(Continued)

FOREIGN PATENT DOCUMENTS

JP 55-064319 A 5/1980
JP 2001-135205 A 5/2001
(Continued)

OTHER PUBLICATIONS

Office Action dated Feb. 26, 2019, by the Canadian Patent Office in corresponding Canadian Patent Application No. 3,007,185. (5 pages).
(Continued)

*Primary Examiner* — Rexford N Barnie
*Assistant Examiner* — Toan T Vu
(74) *Attorney, Agent, or Firm* — Buchanan Ingersoll & Rooney PC

(57) ABSTRACT

A power switching control device includes a unit to measure a power-supply-side voltage of a circuit breaker, a unit to calculate a current that flows through a resistor after a switch is turned on and before a circuit breaking unit is turned on, and to calculate an interelectrode voltage of the circuit breaking unit after the switch is turned on and before the circuit breaking unit is turned on, a unit to determine a target closing time point for the circuit breaking unit so that a target turn-on phase for the circuit breaking unit becomes a phase that is set in accordance with the capacitor, and to output a control signal such that the circuit breaking unit is closed at the target closing time point.

3 Claims, 10 Drawing Sheets

(51) Int. Cl.
*H01H 9/56* (2006.01)
*H01H 33/59* (2006.01)
*H01H 33/16* (2006.01)

(58) Field of Classification Search
USPC ..... 307/130, 65, 125, 140; 318/807, 812; 361/42, 19, 20, 35, 38, 58, 93.1; 322/45
See application file for complete search history.

(56) References Cited

U.S. PATENT DOCUMENTS

| | | | | |
|---|---|---|---|---|
| 2004/0212353 | A1* | 10/2004 | Nelson | H02P 9/006 322/45 |
| 2011/0211288 | A1* | 9/2011 | Koshizuka | H02H 9/002 361/91.1 |
| 2013/0221760 | A1 | 8/2013 | Mori et al. | |
| 2016/0178687 | A1 | 6/2016 | Yamamoto et al. | |

FOREIGN PATENT DOCUMENTS

| | | | |
|---|---|---|---|
| JP | 2008-153037 | A | 7/2008 |
| WO | WO 00/004564 | A1 | 1/2000 |
| WO | WO 2012/095958 | A1 | 7/2012 |
| WO | WO 2015/019418 | A1 | 2/2015 |

OTHER PUBLICATIONS

International Search Report (PCT/ISA/210) dated Mar. 1, 2016, by the Japan Patent Office as the International Searching Authority for International Application No. PCT/JP2015/084481.

Written Opinion (PCT/ISA/237) dated Mar. 1, 2016, by the Japan Patent Office as the International Searching Authority for International Application No. PCT/JP2015/084481.

Yoshibumi Yamagata, et al., "Development of a two-point gas breaker for 1,000 kV GIS", 1453, Collection of Papers of the 1994, Annual Meeting of the Institute of Electrical Engineers of Japan, Collection of Papers of the 1994.

Yoshibumi Yamagata, et al., "Development of a 1,000 kV Gas Breaker for GIS", 1454, Collection of Papers of the 1994, Annual Meeting of the Institute of Electrical Engineers of Japan, Collection of Papers of the 1994.

Yoshibumi Yamagata, et al., "Method for Testing Small Capacitive Current Shut-off of a 1,000 kV Gas Breaker", 1455, Collection of Papers of the 1994, Annual Meeting of the Institute of Electrical Engineers of Japan.

* cited by examiner

POWER SWITCHING CONTROL DEVICE

FIELD

The present invention relates to a power switching control device that controls opening and closing of a circuit breaker which is a power switchgear.

BACKGROUND

A capacitor or a reactor, which serves as a phase modifier, is connected to a system through a circuit breaker and used to modify the phase of a system voltage.

In general, there is a possibility in that when the phase modifier is closed in the system through the circuit breaker, a surge voltage or an inrush current may be generated in the phase modifier depending on the timing at which the circuit breaker is closed.

A so-called "circuit breaker" with an input resistance is a commonly-known method of suppressing the surge voltage or the inrush current described above.

For example, a circuit breaker with an input resistance described in FIG. 10 in Patent Literature 1 includes a resistor connected in parallel to the circuit breaker, and a switch connected in series to this resistor and connected in parallel to the circuit breaker.

In the conventional circuit breaker with an input resistance as described above, when a capacitor that serves as a phase modifier is to be closed, first a switch is closed to apply a power-supply voltage to the capacitor. A current generated by a transient surge voltage at the time when the resistance is input is sharply attenuated by the resistor. Therefore, the capacitor is applied with a voltage with the same frequency as that of the power-supply voltage and an amplitude lower than that of the power-supply voltage. Thereafter, when a main contact of the circuit breaker is closed, an inrush current that flows to the capacitor is suppressed because the capacitor has been already applied with the voltage an amplitude of which is lower than that of the power-supply voltage, through the resistor.

CITATION LIST

Patent Literature

Patent Literature 1: International Publication No. WO2000/004564

SUMMARY

Technical Problem

However, in the conventional circuit breaker with an input resistance, after the switch for inputting the resistor is closed, a current, which is determined based on a resistance value of the resistor and an impedance of the phase modifier, flows through the resistor before the main contact of the circuit breaker is closed. Thus, there is a difference in potential between electrodes of the circuit breaker connected in parallel to the resistor. Therefore, due to this difference in potential, there is still a possibility in that a surge voltage or an inrush current may be generated when the circuit breaker is closed.

The present invention has been achieved in view of the above problems, and an object of the present invention is to provide a power switching control device that is capable of further suppressing a surge voltage or an inrush current.

Solution to Problem

A power switching control device according to an aspect of the present invention that controls opening and closing of a circuit breaker including a circuit breaking unit, a resistor connected in parallel to the circuit breaking unit, and a switch connected in parallel to the circuit breaking unit and connected in series to the resistor to be turned on prior to the circuit breaking unit, one end of the circuit breaking unit being connected to an AC power supply and the other end of the circuit breaking unit being connected to a phase modifier, includes: a voltage measurement unit to measure a power-supply-side voltage of the circuit breaker; an interelectrode-voltage calculation unit to calculate a current that flows through the resistor after the switch is turned on and before the circuit breaking unit is turned on by using a measurement value of the power-supply-side voltage, a resistance value of the resistor, and an impedance of the phase modifier, and to calculate an interelectrode voltage of the circuit breaking unit after the switch is turned on and before the circuit breaking unit is turned on by using the current and the resistance value; a target closing time-point determination unit to determine a target closing time point for the circuit breaking unit from which a target turn-on phase for the circuit breaking unit is obtained, the target turn-on phase being set in accordance with the phase modifier, by using an interelectrode rate of decrease of dielectric strength and the interelectrode voltage of the circuit breaking unit; and a closing control unit to output a control signal to the circuit breaker such that the circuit breaking unit is closed at the target closing time point.

Advantageous Effects of Invention

According to the present invention, there is an effect where it is possible to further suppress a surge voltage or an inrush current.

DESCRIPTION OF EMBODIMENTS

A power switching control device according to embodiments of the present invention will be described in detail below with reference to the accompanying drawings. The present invention is not limited to the embodiments.

First Embodiment

Figure 1:
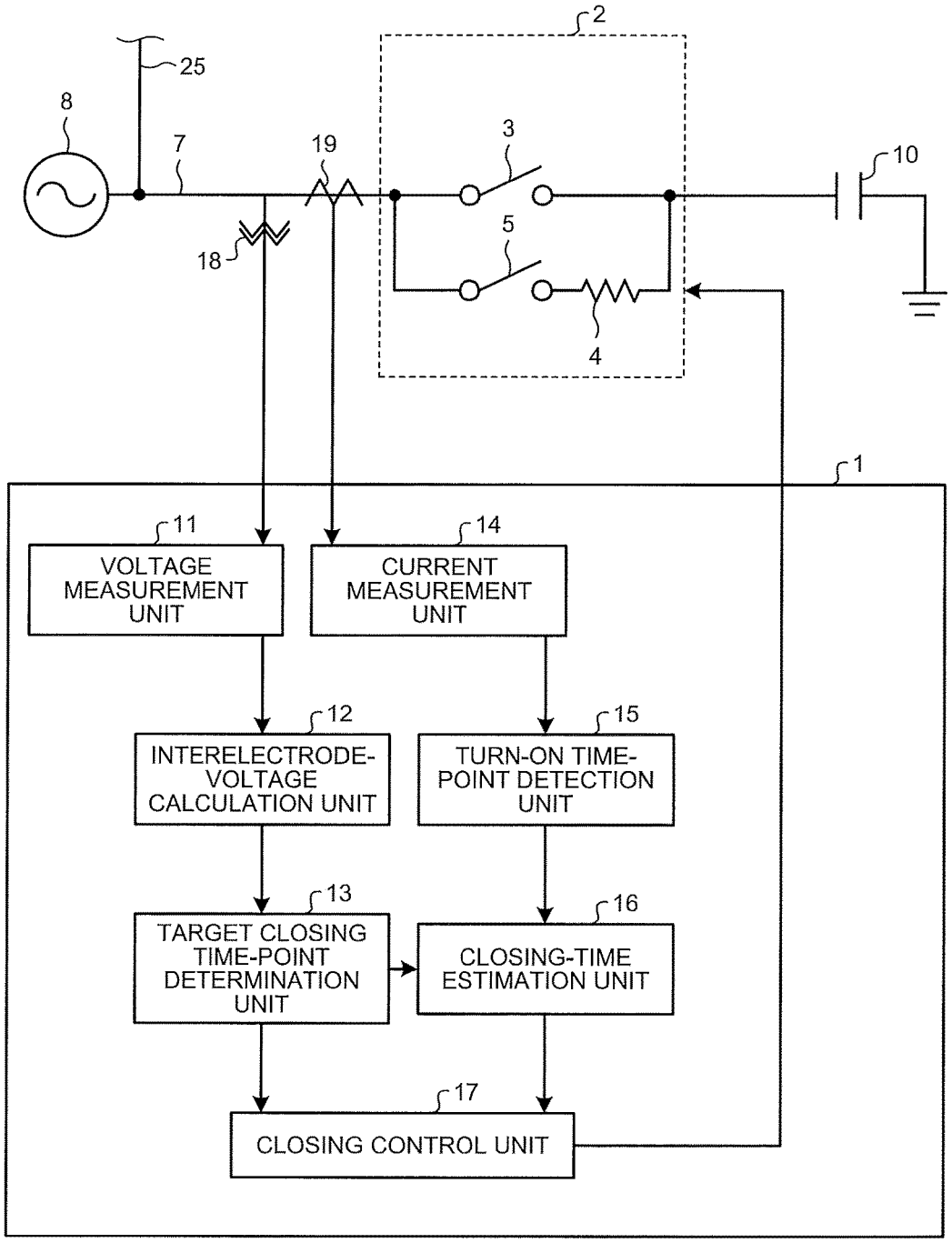
FIG. 1 is a diagram illustrating a configuration of a power switching control device according to a first embodiment.

FIG. 1 is a diagram illustrating a configuration of a power switching control device 1 according to a first embodiment of the present invention. The power switching control device 1 is connected to a circuit breaker 2 which is a power switchgear, and controls opening and closing of the circuit breaker 2. FIG. 1 illustrates only a function of the power switching control device 1 for closing the circuit breaker 2, and omits illustrations of a function for opening the circuit breaker 2.

The circuit breaker 2 is a so-called "gas circuit breaker" with an input resistance. That is, the circuit breaker 2 includes a circuit breaking unit 3, a resistor 4 which is an input resistance connected in parallel to the circuit breaking unit 3, and a switch 5 connected in parallel to the circuit breaking unit 3 and connected in series to the resistor 4. Generally, the resistance value of the resistor 4 is 500Ω to 1000Ω.

Figure 2:
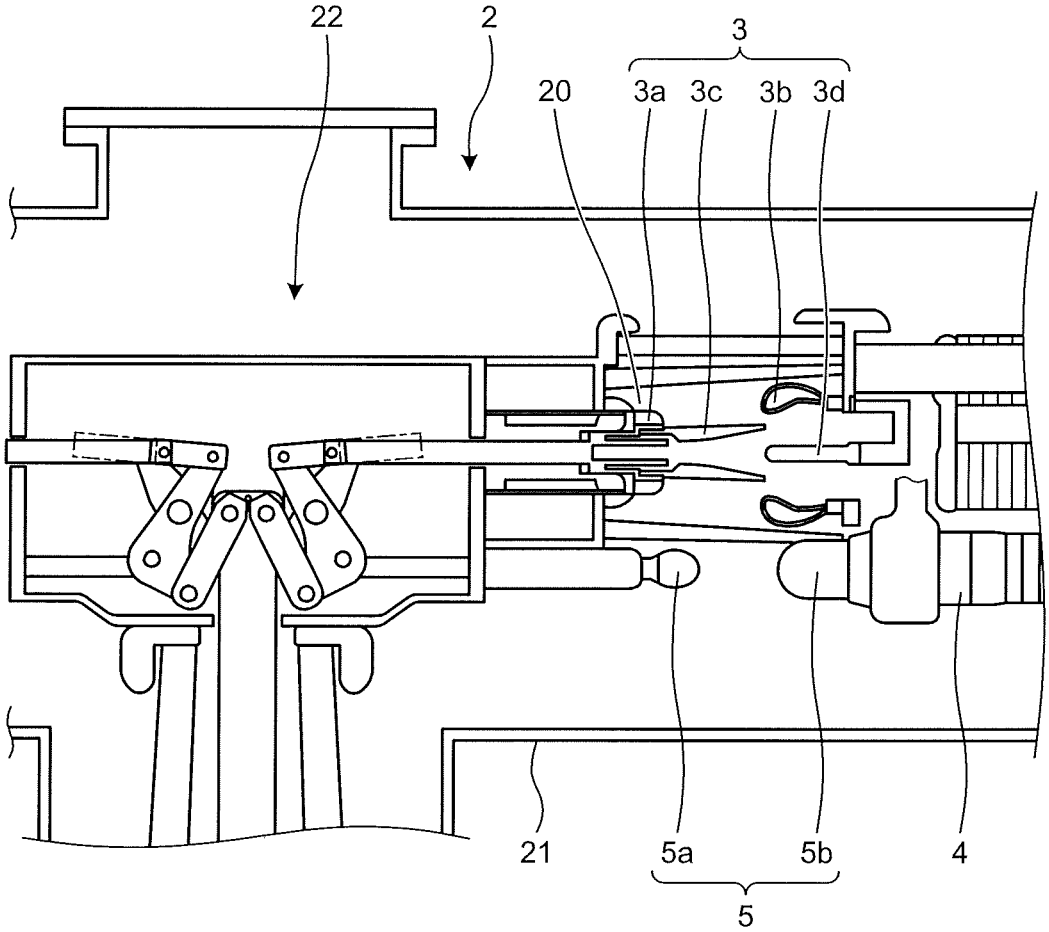
FIG. 2 is a cross-sectional diagram illustrating an internal configuration of a circuit breaker according to the first embodiment.

FIG. 2 is a cross-sectional diagram illustrating an internal configuration of the circuit breaker 2. In FIG. 2, the circuit breaker 2 is in an open state. The circuit breaking unit 3 includes a movable main contact 3*a*, a fixed main contact 3*b* facing to the movable main contact 3*a*, a movable arc contact 3*c* that operates in conjunction with the movable main contact 3*a*, and a fixed arc contact 3*d* facing to the movable arc contact 3*c*. The movable main contact 3*a*, the fixed main contact 3*b*, the movable arc contact 3*c*, and the fixed arc contact 3*d* are located in an arc-extinguishing chamber 20. The switch 5 includes a movable resistance contact 5*a* that operates in conjunction with the movable main contact 3*a*, and a fixed resistance contact 5*b* facing to the movable resistance contact 5*a*. The movable resistance contact 5*a* and the fixed resistance contact 5*b* are located in a metal container 21 outside the arc-extinguishing chamber 20. The metal container 21 is filled with insulating gas. Further, the circuit breaker 2 includes an operation mechanism 22 in the metal container 21. The operation mechanism 22 reciprocates the movable main contact 3*a*, the movable arc contact 3*c*, and the movable resistance contact 5*a*.

The movable resistance contact 5*a* is mechanically coupled with the movable main contact 3*a* and the movable arc contact 3*c* through the operation mechanism 22. Due to this coupling structure, the switch 5 is closed prior to the circuit breaking unit 3 at the time when the circuit breaker 2 is closed. More specifically, the movable main contact 3*a* comes into contact with the fixed main contact 3*b* after a given time has elapsed since the movable resistance contact 5*a* comes into contact with the fixed resistance contact 5*b*. The given time is, for example, 10 milliseconds.

Figure 3:
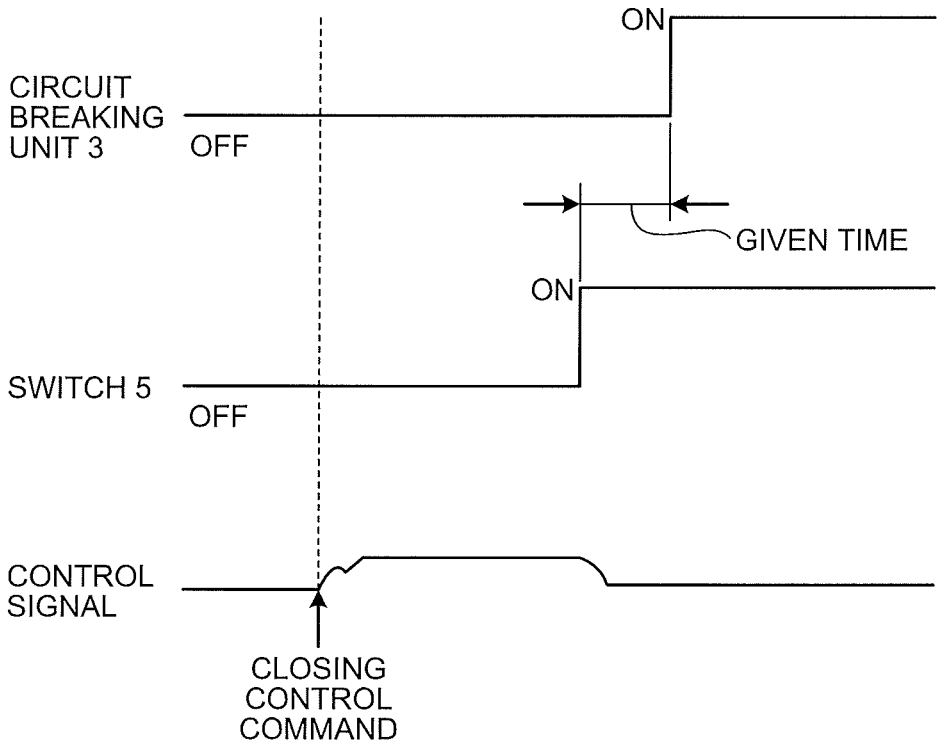
FIG. 3 is a diagram illustrating an on/off state of a contact of the circuit breaker at the time of a closing operation according to the first embodiment.

FIG. 3 is a diagram illustrating an on/off state of a contact of the circuit breaker 2 at the time of a closing operation. An upper part of FIG. 3 illustrates on/off of the circuit breaking unit 3. A middle part in FIG. 3 illustrates on/off of the switch 5. A lower part in FIG. 3 illustrates control details of a control signal to be output from the power switching control device 1 to the circuit breaker 2. When a closing control command is output from the power switching control device 1, first the switch 5 is changed from an off state to an on state. When a given time has elapsed thereafter, the circuit breaking unit 3 is changed from an off state to an on state. Although details are omitted, the switch 5 is opened prior to the circuit breaking unit 3 at the time of opening the circuit breaker 2.

As illustrated in FIG. 1, the circuit breaker 2 is connected to a power supply 8 which is an AC power supply through a busbar 7. Specifically, one end of the circuit breaking unit 3 is connected to the power supply 8. Further, the circuit breaker 2 is connected to a capacitor 10 which is a phase modifier. Specifically, the other end of the circuit breaking unit 3 is connected to the capacitor 10. One end of the capacitor 10 is connected to the circuit breaking unit 3, while the other end of the capacitor 10 is grounded. In the example illustrated in FIG. 1, the power supply 8 is connected to a power transmission line 25.

For simplicity, FIG. 1 illustrates a configuration of the power switching control device 1 for a single phase. However, for multiple phases, the power switching control device 1 can be extended easily by providing components corresponding to the number of multiple phases.

Next, a functional configuration of the power switching control device 1 will be described. The power switching control device 1 includes a voltage measurement unit 11, an interelectrode-voltage calculation unit 12, a target closing time-point determination unit 13, a current measurement unit 14, a turn-on time-point detection unit 15, a closing-time estimation unit 16, and a closing control unit 17.

The voltage measurement unit 11 measures a power-supply-side voltage which is a voltage between the power supply 8 and the circuit breaker 2. Specifically, the voltage measurement unit 11 measures the power-supply-side voltage through an instrument transformer 18 that is attached to the busbar 7. The voltage measurement unit 11 outputs a measurement value of the power-supply-side voltage to the interelectrode-voltage calculation unit 12.

The interelectrode-voltage calculation unit 12 uses the measurement value of the power-supply-side voltage, a resistance value of the resistor 4, and an impedance of the capacitor 10 to calculate a current Ic that flows through the resistor 4 after the switch 5 is turned on and before the circuit breaking unit 3 is turned on. Where the power-supply-side voltage, that is, the voltage of the power supply 8 is represented as V, the resistance value of the resistor 4 is represented as R, and the impedance of the capacitor 10 is represented as Z, the interelectrode-voltage calculation unit 12 calculates the current Ic on the basis of the following equation by using the voltage V, the resistance value R of the resistor 4, and the impedance Z of the capacitor 10.

$$Ic=V/(R+Z) \quad (1)$$

Where the frequency of the power supply 8 is represented as ω, the capacitance of the capacitor 10 is represented as C, and an imaginary unit is represented as j, the impedance Z of the capacitor 10 is expressed by the following equation.

$$Z=1/(j\omega C) \quad (2)$$

Information regarding the capacitance C is given to the interelectrode-voltage calculation unit 12 in advance. In a case where information regarding the frequency ω has been already known from the conditions of the system, this information is given to the interelectrode-voltage calculation unit 12 in advance. However, the frequency ω can also be derived from the measurement value of the power-supply-side voltage. The amplitude of the voltage V can be derived from a maximum value and a minimum value of the measurement values of the power-supply-side voltage. The phase of the voltage V can be derived from zero-crossing points of the measurement values of the power-supply-side voltage. The frequency co of the voltage V can be derived from an interval between the zero-crossing points of the power-supply-side voltage.

Further, the interelectrode-voltage calculation unit 12 uses the current Ic and the resistance value R of the resistor 4 to calculate an interelectrode voltage ΔV of the circuit breaking unit 3 after the resistor 4 is turned on and before the circuit breaking unit 3 is turned on. The interelectrode-voltage calculation unit 12 calculates the interelectrode voltage ΔV on the basis of the following equation.

$$\Delta V=Ic\times R \quad (3)$$

The interelectrode-voltage calculation unit 12 outputs the interelectrode voltage ΔV to the target closing time-point determination unit 13.

The target closing time-point determination unit 13 uses the interelectrode voltage ΔV and a rate of decrease of dielectric strength (RDDS) of the circuit breaking unit 3 to determine a target closing time point for turning on the circuit breaking unit 3 at a target phase. The dielectric strength of the circuit breaking unit 3 decreases as an interelectrode distance of the circuit breaking unit 3 decreases in the process of closing of the circuit breaker 2. The rate of decrease of dielectric strength expresses the rate of decrease in dielectric strength of this interelectrode. Information regarding the rate of decrease of dielectric strength is given to the target closing time-point determination unit 13 in advance.

The target phase is a phase at which the circuit breaking unit 3 is electrically turned on. The target closing time point is a time point at which the circuit breaking unit 3 is mechanically turned on. The state in which the circuit breaking unit 3 is electrically turned on refers to a state in which preceding arc has occurred between the electrodes, and thus the electrodes are electrically conductive with each other although these electrodes are not mechanically in contact with each other. The state in which the circuit breaking unit 3 is mechanically turned on refers to a state in which the electrodes are mechanically in contact with each other, that is, the movable main contact 3*a* and the fixed main contact 3*b* are in contact with each other, and the turn-on operation is finished. In the following descriptions, when simply referring to "turn on", it means electrical turn on, and when simply referring to "closing", it means mechanical turn on.

The current measurement unit 14 measures a power-supply-side current which is a current flowing between the power supply 8 and the circuit breaker 2. Specifically, the current measurement unit 14 measures a power-supply-side current through an instrument current transformer 19 that is attached to the busbar 7. The current measurement unit 14 outputs a measurement value of the power-supply-side current to the turn-on time-point detection unit 15.

The turn-on time-point detection unit 15 detects a turn-on time point from the measurement value of the power-supply-side current. The turn-on time point refers to a time point at which the circuit breaking unit 3 is electrically turned on. The turn-on time-point detection unit 15 outputs the turn-on time point to the closing-time estimation unit 16.

The closing-time estimation unit 16 estimates a closing time in accordance with operating conditions of the circuit breaker 2. The operating conditions of the circuit breaker 2 are an ambient temperature, a control voltage, and an operation pressure of the circuit breaker 2. The closing time is a period of time from when the circuit breaker 2 starts operating to when the circuit breaker 2 is closed, that is, when the circuit breaker 2 is mechanically turned on.

Specifically, the closing-time estimation unit 16 is given in advance the information regarding reference values of the operating conditions, and a reference value of the closing time corresponding to the reference values of the operating conditions. When actual operating conditions are input to the closing-time estimation unit 16 from the outside of the power switching control device 1, the closing-time estimation unit 16 compares the values of the actual operating conditions with the reference values of the operating conditions. The closing-time estimation unit 16 then calculates the amount of correction from the reference value of the closing time in accordance with variations in values of the actual operating conditions from the reference values of the operating conditions, and sets a time, obtained by adding the amount of correction to the reference value of the closing time, as an estimation value of the closing time.

The closing time varies depending on operation histories of the individual circuit breaker 2 including contact wear and time-dependent changes of the individual circuit breaker 2. Thus, the closing-time estimation unit 16 corrects the estimation value of the closing time in accordance with the operation histories of the circuit breaker 2. More specifically, the closing-time estimation unit 16 calculates an error between a target turn-on time point described later and the actual turn-on time point, and corrects the estimation value of the closing time so as to cancel out this error. For example, a plurality of previous errors are calculated, and then more recent errors are more heavily weighted to derive a weighted average of the previous errors. Thus, the estimation value of the closing time can be corrected so as to cancel out the weighted average of the errors.

The target turn-on time point is output from the target closing time-point determination unit 13 to the closing-time estimation unit 16. The closing-time estimation unit 16 outputs the estimation value of the closing time to the closing control unit 17.

Upon reception of a command to close the circuit breaker 2 from the outside of the power switching control device 1, the closing control unit 17 outputs a control signal to the circuit breaker 2 such that the circuit breaking unit 3 is closed at the target closing time point. That is, the closing control unit 17 outputs a closing control command to the circuit breaker 2 at a time point earlier than the target closing time point by the estimation value of the closing time.

Figure 4:
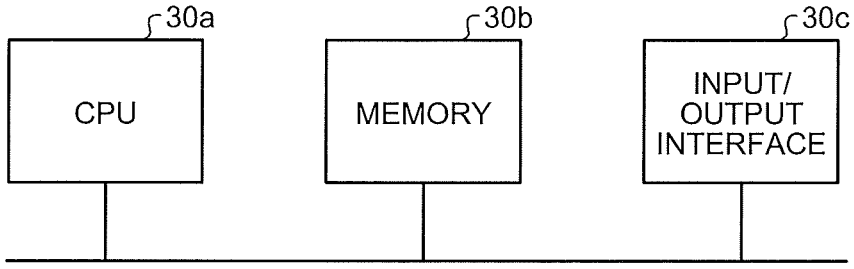
FIG. 4 is a block diagram illustrating a hardware configuration of the power switching control device according to the first embodiment.

FIG. 4 is a block diagram illustrating a hardware configuration of the power switching control device 1. As illustrated in FIG. 4, the power switching control device 1 includes a CPU 30*a*, a memory 30*b*, and an input/output interface 30*c*. The voltage measurement unit 11 in FIG. 1 is configured by the CPU 30*a*, the memory 30*b*, and the input/output interface 30*c*. The interelectrode-voltage calculation unit 12 in FIG. 1 is configured by the CPU 30*a* and the memory 30*b*. The target closing time-point determination unit 13 in FIG. 1 is configured by the CPU 30*a* and the memory 30*b*. The current measurement unit 14 in FIG. 1 is configured by the CPU 30*a*, the memory 30*b*, and the input/output interface 30*c*. The turn-on time-point detection unit 15 in FIG. 1 is configured by the CPU 30*a* and the memory 30*b*. The closing-time estimation unit 16 in FIG. 1 is configured by the CPU 30*a* and the memory 30*b*. The closing control unit 17 in FIG. 1 is configured by the CPU 30*a*, the memory 30*b*, and the input/output interface 30*c*.

Figure 5:
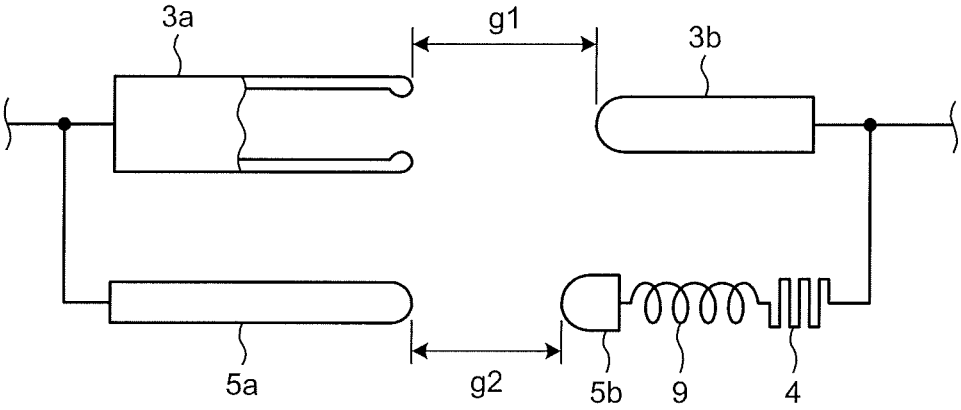
FIG. 5 is a schematic diagram of the contact in a state in which a circuit breaking unit and a switch are both opened according to the first embodiment.
Figure 6:
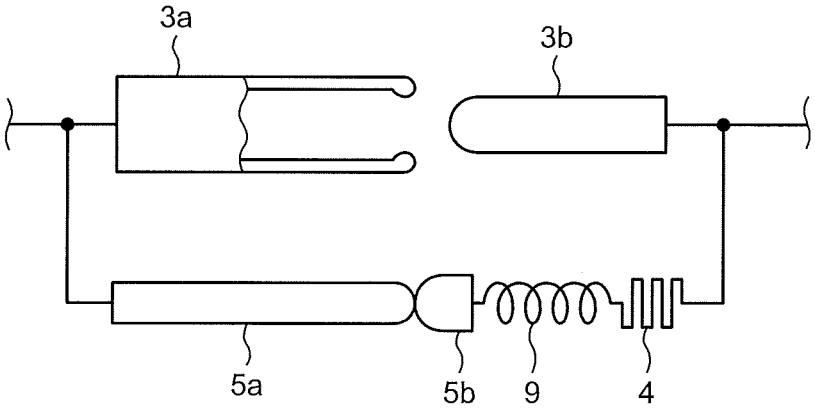
FIG. 6 is a schematic diagram of the contact in a state in which the switch is closed, while the circuit breaking unit is opened according to the first embodiment.
Figure 7:
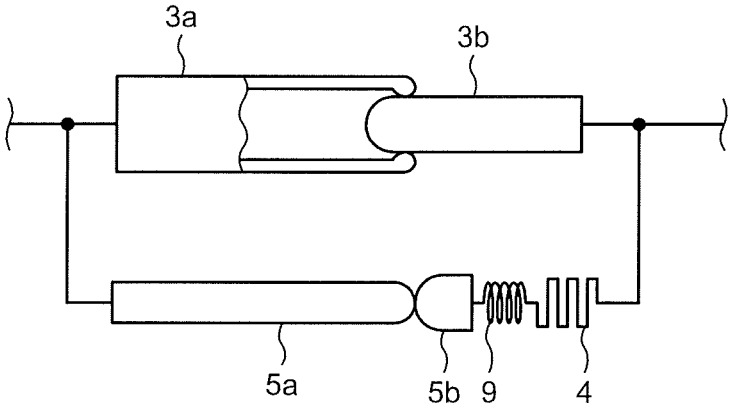
FIG. 7 is a schematic diagram of the contact in a state in which the circuit breaking unit and the switch are both closed according to the first embodiment.

Next, an operation of the power switching control device 1 according to the present embodiment will be described. First, a closing operation of the circuit breaker 2 will be described. FIGS. 5 to 7 are schematic diagrams of a contact of the circuit breaker 2 at the time of a closing operation. In FIGS. 5 to 7, constituent elements identical to those in FIGS. 1 and 2 are denoted by like reference signs.

FIG. 5 is a diagram illustrating a state in which the circuit breaking unit 3 and the switch 5 are both opened. The movable main contact 3*a* and the fixed main contact 3*b* are in a non-contact state. The distance between these contacts is represented as g1. The movable resistance contact 5*a* and the fixed resistance contact 5*b* are in a non-contact state. The distance between these contacts is represented as g2. The distance g1 is longer than the distance g2. A coil spring 9 is provided between the fixed resistance contact 5*b* and the resistor 4.

FIG. 6 is a diagram illustrating a state in which the switch 5 is closed, while the circuit breaking unit 3 is opened. The movable main contact 3*a* and the fixed main contact 3*b* are in a non-contact state, while the movable resistance contact 5*a* is in contact with the fixed resistance contact 5*b*. In this manner, the switch 5 is turned on prior to the circuit breaking unit 3.

FIG. 7 is a diagram illustrating a state in which the circuit breaking unit 3 and the switch 5 are both closed. When the coil spring 9 is contracted, this brings the movable main contact 3*a* into contact with the fixed main contact 3*b*, and the movable resistance contact 5*a* is in contact with the fixed resistance contact 5*b*.

Figure 8:
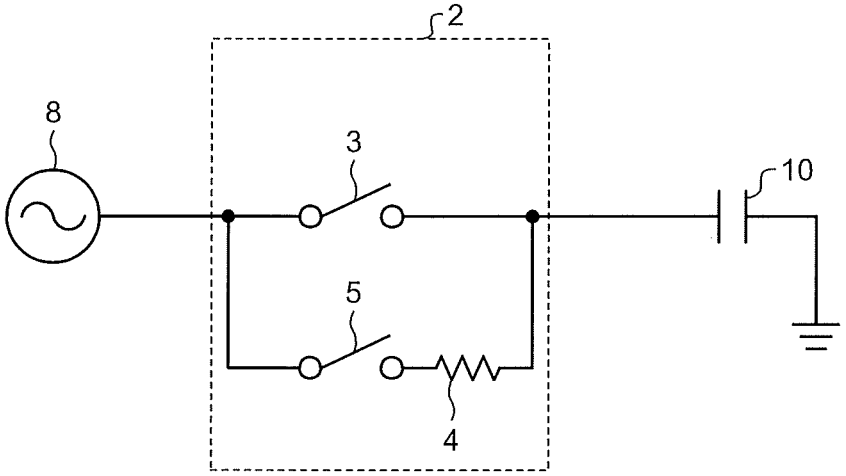
FIG. 8 is a first circuit diagram illustrating an energization state of the circuit breaker at the time of a closing operation according to the first embodiment.
Figure 9:
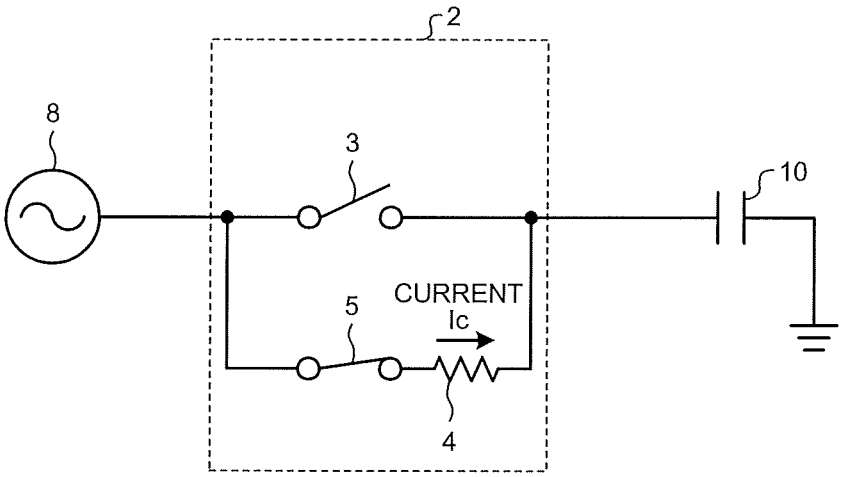
FIG. 9 is a second circuit diagram illustrating an energization state of the circuit breaker at the time of the closing operation according to the first embodiment.
Figure 10:
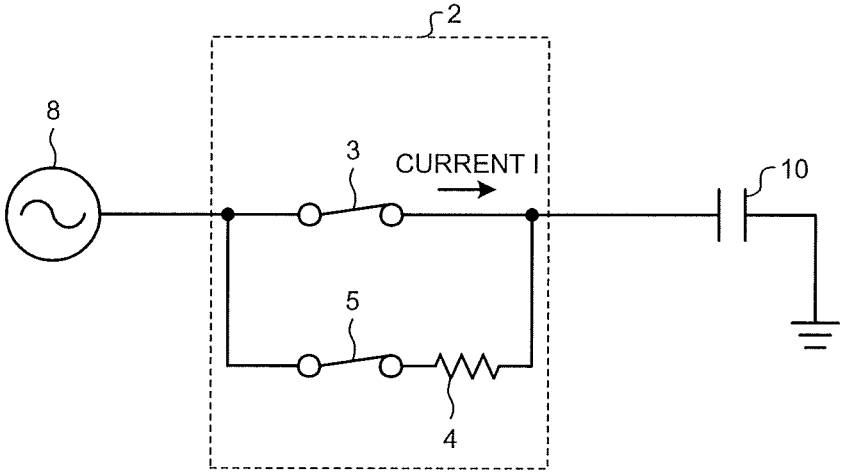
FIG. 10 is a third circuit diagram illustrating an energization state of the circuit breaker at the time of the closing operation according to the first embodiment.

FIGS. 8 to 10 are circuit diagrams illustrating an energization state of the circuit breaker 2 at the time of a closing operation. FIG. 8 is a circuit diagram illustrating a state in which the circuit breaking unit 3 and the switch 5 are both opened. FIG. 9 is a circuit diagram illustrating a state in which the switch 5 is closed, while the circuit breaking unit 3 is opened. FIG. 10 is a circuit diagram illustrating a state in which the circuit breaking unit 3 and the switch 5 are both closed. In FIGS. 8 to 10, constituent elements identical with those in FIGS. 1 and 2 are denoted by like reference signs.

When a closing control command is input to the circuit breaker 2, the circuit breaker 2 shifts from the state illustrated in FIG. 8 to the state illustrated in FIG. 9, and the switch 5 is turned on prior to the circuit breaking unit 3. At this time, the current Ic flows through the resistor 4. The current Ic is derived from the equation (1) and the equation (2) described above. Due to the current Ic flowing through the resistor 4, the interelectrode voltage ΔV is generated between the electrodes of the circuit breaking unit 3 that is connected in parallel to the resistor 4. The interelectrode voltage ΔV is derived from the equation (3) described above. As illustrated in FIG. 10, the circuit breaking unit 3 is turned on after the switch 5 has been turned on, and thus a current I flows through the circuit breaking unit 3.

In this manner, the circuit breaking unit 3 is turned on in a state in which the interelectrode voltage ΔV has been generated. Accordingly, there is a possibility in that a surge voltage or an inrush current corresponding to the interelectrode voltage ΔV may be generated in the circuit breaking unit 3.

Next, an operation of the target closing time-point determination unit 13, that is, processing for determining the target closing time point will be described.

In general, in a process of closing a circuit breaker, interelectrode dielectric strength decreases with a decrease in an interelectrode distance. At the time point when this dielectric strength becomes equal to or lower than the interelectrode voltage, preceding arc occurs in conjunction with a dielectric breakdown, to electrically turn on the circuit breaker. A point at which the circuit breaker is electrically turned on is expressed as an intersection between an absolute-value waveform of the interelectrode voltage of the circuit breaker, and a characteristic line indicating the rate of decrease of dielectric strength (RDDS) of the circuit breaker. A closing point at which the circuit breaker is mechanically turned on is expressed as an intersection between this characteristic line and a straight line indicating "voltage=0".

Figure 11:
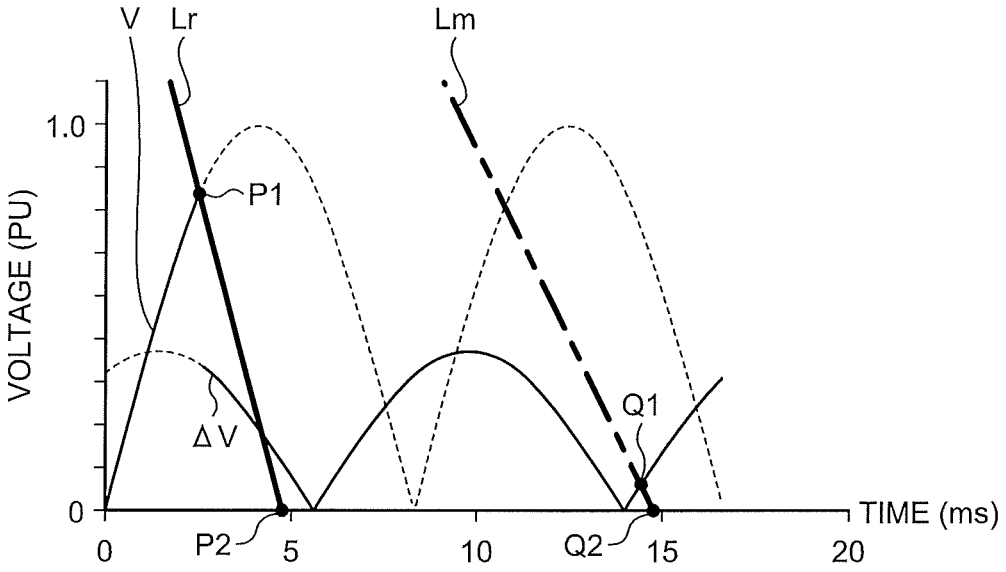
FIG. 11 is an explanatory diagram of a target closing time point for the circuit breaking unit according to the first embodiment.

FIG. 11 is an explanatory diagram of a target closing time point for the circuit breaking unit 3. The horizontal axis represents a time (ms), while the vertical axis represents a voltage (PU). In FIG. 11, ms indicates millisecond, and PU indicates a voltage on the basis of the rated voltage. The voltage V indicates an absolute-value waveform of the voltage of the power supply 8. The interelectrode voltage ΔV indicates an absolute-value waveform of the interelectrode voltage ΔV. A characteristic line Lr indicates the rate of decrease of dielectric strength (RDDS) of the switch 5. A characteristic line Lm indicates the rate of decrease of dielectric strength (RDDS) of the circuit breaking unit 3.

An intersection P1 between the characteristic line Lr and the voltage V is a point at which the switch 5 is electrically turned on. At a time point corresponding to the intersection P1 or later, the interelectrode voltage ΔV is generated in the circuit breaking unit 3. An intersection P2 between the characteristic line Lr and the horizontal axis is a closing point for the switch 5 at which the switch 5 is mechanically turned on. The horizontal axis also serves as a straight line that indicates "voltage=0".

An intersection Q1 between the characteristic line Lm and the interelectrode voltage ΔV is a point at which the circuit breaking unit 3 is electrically turned on. A time point corresponding to the intersection Q1 gives a target turn-on time point for the circuit breaking unit 3. A phase at the intersection Q1 gives a target turn-on phase for the circuit breaking unit 3. An intersection Q2 between the characteristic line Lm and the horizontal axis is a closing point for the circuit breaking unit 3 at which the circuit breaking unit 3 is mechanically turned on. A time point corresponding to the intersection Q2 expresses a target closing time point for the circuit breaking unit 3.

A difference in time point between the intersection P2 and the intersection Q2 is a period of time from when the switch 5 is closed to when the circuit breaking unit 3 is closed. This is the given time described above, which is determined depending on the circuit breaker 2. In the example illustrated in FIG. 11, the given time is 10 milliseconds.

In a case where the phase modifier is the capacitor 10, a surge voltage or an inrush current generated in the circuit breaking unit 3 is more suppressed as the absolute value of the turn-on voltage for the circuit breaking unit 3 becomes smaller. This turn-on voltage is the interelectrode voltage ΔV at the time when the circuit breaking unit 3 is electrically turned on. Therefore, it is desirable that the target turn-on phase is a phase at which the absolute value of the turn-on voltage is minimized. In other words, when an arbitrary target turn-on phase is set, it is difficult to suppress the surge voltage or the inrush current.

The target turn-on phase as described above can be determined by calculating a voltage at the intersection Q1 by displacing the characteristic line Lm in parallel to the direction along the time axis. When the target turn-on phase has been determined, a target closing time point can be determined as the intersection Q2 corresponding to the intersection Q1 in this case.

However, in addition to the variations in closing time of the circuit breaker 2, the occurrence of arcing in the circuit breaking unit 3 is a probabilistic phenomenon. Thus, the actual rate of decrease of dielectric strength (RDDS) of the circuit breaking unit 3 varies around the average value. It is assumed that the variations in interelectrode RDDS of the circuit breaking unit 3 follow a normal distribution. When a standard deviation of the variations in rate of decrease of dielectric strength (RDDS) of the circuit breaking unit 3 is represented as σ, the variation range of the characteristic line Lm can be defined by characteristic lines Lm1 and Lm2. The characteristic line Lm1 is obtained by displacing the characteristic line Lm in parallel to the direction along the time axis by "−3σ". The characteristic line Lm2 is obtained by displacing the characteristic line Lm in parallel to the direction along the time axis by "+3σ". In this case, the characteristic line Lm represents the average. While the variation range of the characteristic line Lm is defined as "average ±3σ", it is also allowable to define a variation range other than this variation range.

Figure 12:
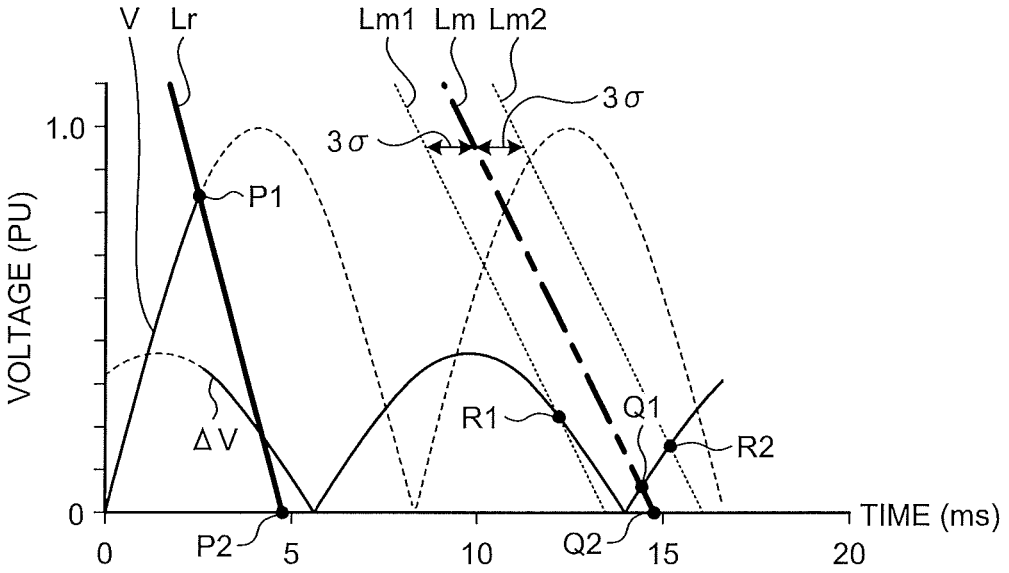
FIG. 12 is another explanatory diagram of the target closing time point for the circuit breaking unit according to the first embodiment.

FIG. 12 is another explanatory diagram of the target closing time point for the circuit breaking unit 3. In FIG. 12, in addition to the descriptions in FIG. 11, the characteristic lines Lm1 and Lm2 are also illustrated. The intersection between the characteristic line Lm1 and the interelectrode voltage ΔV is represented as R1. The intersection between the characteristic line Lm2 and the interelectrode voltage ΔV is represented as R2.

As illustrated in FIG. 12, in a case where the variation range of the characteristic line Lm is defined by the characteristic lines Lm1 and Lm2, and where the phase modifier is the capacitor 10, the target turn-on phase can be determined as follows. That is, the target turn-on voltage at which the absolute value of the turn-on voltage is minimized, is obtained as a phase at which the maximum turn-on voltage value within the variation range of the characteristic line Lm is minimized.

More specifically, when the characteristic line Lm is given as the average, a specific variation range is defined. Thus, how the turn-on voltage varies within the variation range can be calculated specifically. In the example illustrated in FIG. 12, the maximum turn-on voltage value is a voltage value at the intersection R1. Then, the characteristic line Lm is displaced in parallel to the direction along the time axis to check how the maximum turn-on voltage value changes, and thereby the characteristic line Lm on which the maximum turn-on voltage value is minimized can be derived. At a phase of the intersection Q1 between the interelectrode voltage ΔV and the characteristic line Lm derived as described above, the maximum turn-on voltage value is minimized.

Next, a closing control operation of the power switching control device 1 will be described. First, the voltage measurement unit 11 measures a power-supply-side voltage of the circuit breaker 2, and outputs a measurement value of the power-supply-side voltage to the interelectrode-voltage calculation unit 12. The interelectrode-voltage calculation unit 12 uses the measurement value of the power-supply-side voltage, the resistance value R of the resistor 4, and the impedance Z of the capacitor 10 to calculate the current Ic that flows through the resistor 4 after the switch 5 is turned on and before the circuit breaking unit 3 is turned on. Further, the interelectrode-voltage calculation unit 12 uses the current Ic and the resistance value R to calculate the interelectrode voltage ΔV of the circuit breaking unit 3 after the switch 5 is turned on and before the circuit breaking unit 3 is turned on. The interelectrode-voltage calculation unit 12 outputs the interelectrode voltage ΔV to the target closing time-point determination unit 13.

Subsequently, the target closing time-point determination unit 13 uses the rate of decrease of dielectric strength (RDDS) and the interelectrode voltage ΔV of the circuit breaking unit 3 to determine a target closing time point, which gives the target turn-on phase for the circuit breaking unit 3 that is set in accordance with the capacitor 10. As described above, the target turn-on phase is given as a phase at which the absolute value of the target turn-on voltage is minimized. As the target turn-on phase is determined, the target closing time point is determined by a voltage-zero point on the characteristic line Lm passing through the target turn-on phase. The target closing time-point determination unit 13 outputs the target closing time point to the closing control unit 17.

The closing control unit 17 obtains an estimation value of the closing time from the closing-time estimation unit 16. Upon reception of a command to close the circuit breaker 2 from the outside of the power switching control device 1, the closing control unit 17 outputs a control signal to the circuit breaker 2 such that the circuit breaking unit 3 is closed at the target closing time point. That is, the closing control unit 17 outputs a closing control command to the circuit breaker 2 at a time point earlier than the target closing time point by the estimation value of the closing time.

Because the circuit breaking unit 3 has been conventionally turned on at an arbitrary turn-on phase, it has been difficult even for a circuit breaker with an input resistance to suppress a surge voltage or an inrush current depending on the absolute value of the interelectrode voltage ΔV.

According to the present embodiment, the power switching control device 1 estimates the interelectrode voltage ΔV of the circuit breaking unit 3 after the switch 5 is turned on and before the circuit breaking unit 3 is turned on. Then, the power switching control device 1 determines the target closing time point, which gives the target turn-on phase for the circuit breaking unit 3 that is set in accordance with the capacitor 10. Thus, the power switching control device 1 is capable of further suppressing a surge voltage or an inrush current at the time when the circuit breaking unit 3 is turned on.

Second Embodiment

In the first embodiment, the case in which the phase modifier is the capacitor 10 has been described. In a second embodiment, a case in which the phase modifier is a reactor will be described below. In the following descriptions, differences between the first embodiment and the second embodiment will be mainly explained.

Figure 13:
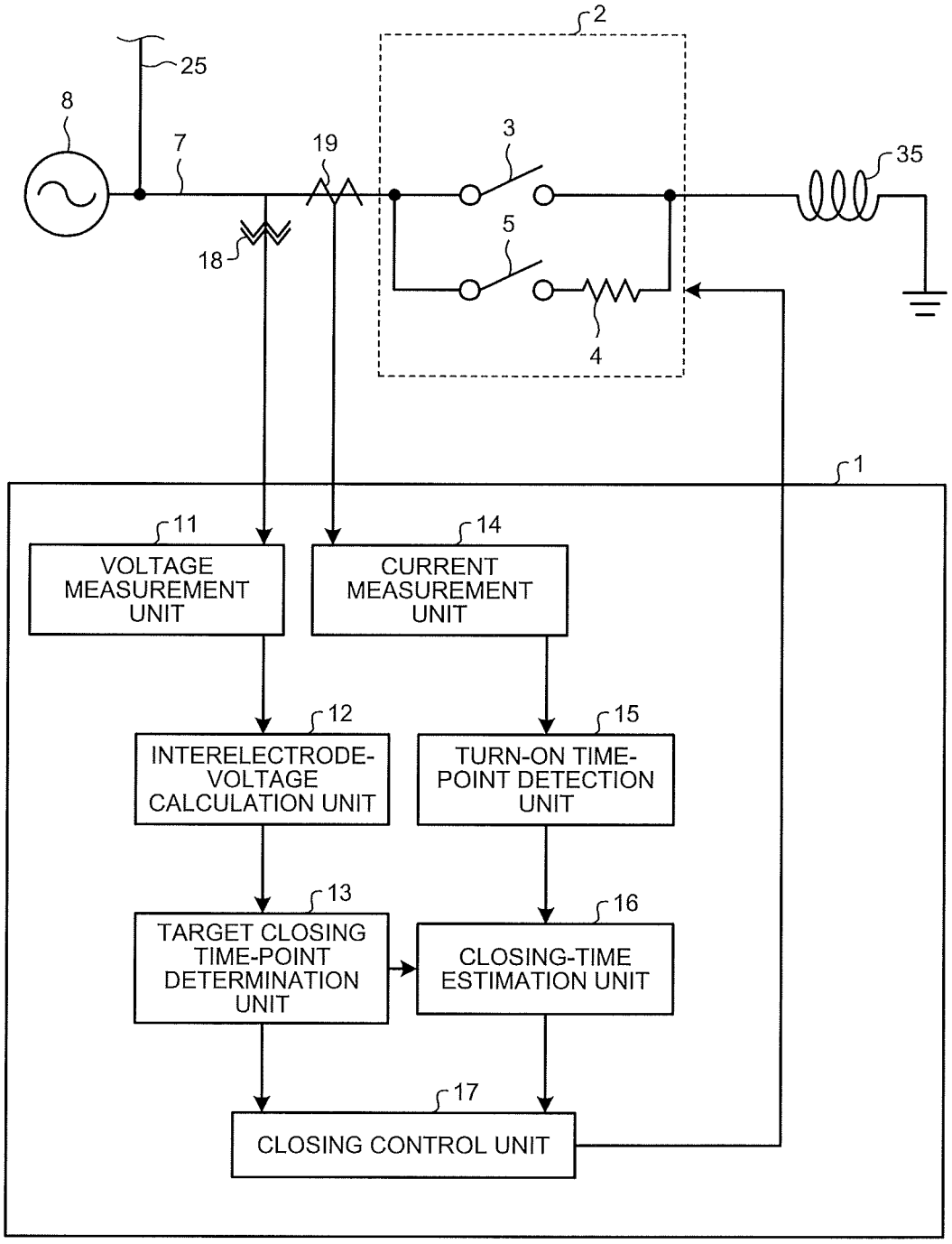
FIG. 13 is a diagram illustrating a configuration of a power switching control device according to a second embodiment.
Figure 14:
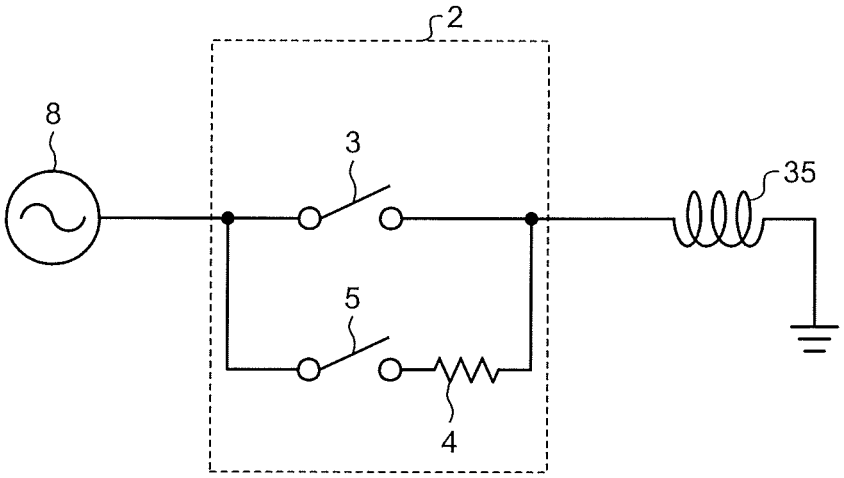
FIG. 14 is a circuit diagram illustrating a state in which a circuit breaking unit and a switch are both opened.

FIG. 13 is a diagram illustrating a configuration of the power switching control device 1 according to the present embodiment. FIG. 14 is a circuit diagram illustrating a state in which the circuit breaking unit 3 and the switch 5 are both opened. In FIGS. 13 and 14, constituent elements identical to those in FIG. 1 are denoted by like reference signs.

As illustrated in FIGS. 13 and 14, the circuit breaker 2 is connected to a reactor 35 which is a phase modifier. Specifically, one end of the reactor 35 is connected to the circuit breaking unit 3, while the other end of the reactor 35 is grounded. The configuration of the power switching control device 1 is identical to the configuration according to the first embodiment.

In a case where the phase modifier is the reactor 35, the interelectrode-voltage calculation unit 12 uses the measurement value of the power-supply-side voltage, the resistance value of the resistor 4, and the impedance of the reactor 35 to calculate the current Ic that flows through the resistor 4 after the switch 5 is turned on and before the circuit breaking unit 3 is turned on. When the power-supply-side voltage, that is, the voltage of the power supply 8 is represented as V, the resistance value of the resistor 4 is represented as R, and the impedance of the reactor 35 is represented as Z, the current Ic is expressed by the equation (1) described above.

The impedance Z of the reactor 35 is expressed by the following equation.

$$Z=j\omega L \tag{4}$$

Here, L represents an inductance value of the reactor 35. Information regarding the inductance value L is given to the interelectrode-voltage calculation unit 12 in advance.

In the same manner as in the first embodiment, the interelectrode-voltage calculation unit 12 uses the current Ic and the resistance value R of the resistor 4 to calculate the interelectrode voltage ΔV of the circuit breaking unit 3 after the resistor 4 is turned on and before the circuit breaking unit 3 is turned on in accordance with the equation (3) described above.

Figure 15:
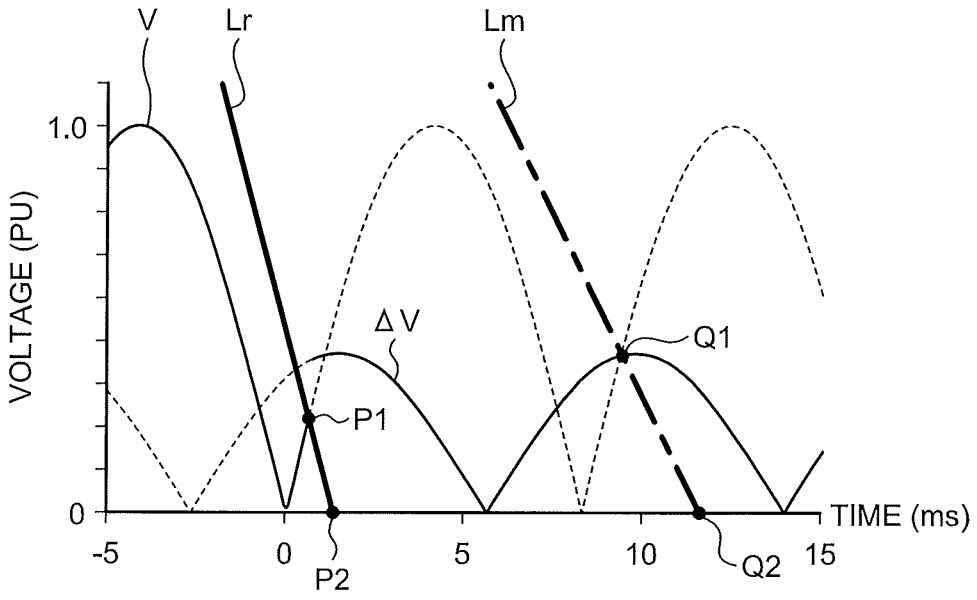
FIG. 15 is an explanatory diagram of a target closing time point for the circuit breaking unit according to the second embodiment.

FIG. 15 is an explanatory diagram of a target closing time point for the circuit breaking unit 3. Similarly to FIG. 11, in FIG. 15, the voltage V indicates an absolute-value waveform of the voltage of the power supply 8. The interelectrode voltage ΔV indicates its absolute-value waveform. The characteristic line Lr indicates the rate of decrease of dielectric strength (RDDS) of the switch 5. The characteristic line Lm indicates the rate of decrease of dielectric strength (RDDS) of the circuit breaking unit 3. Similarly to FIG. 11, the intersection Q1 expresses a point at which the circuit breaking unit 3 is electrically turned on, and the intersection Q2 gives a point at which the circuit breaking unit 3 is closed.

In a case where the phase modifier is the reactor 35, because the reactor 35 is an inductive load, a surge voltage or an inrush current generated in the circuit breaking unit 3 is more suppressed as the absolute value of the turn-on voltage for the circuit breaking unit 3 becomes larger. Therefore, it is desirable that the target turn-on phase in this case is a phase at which the absolute value of the turn-on voltage is maximized. In other words, when an arbitrary target turn-on phase is set, it is difficult to suppress the surge voltage or the inrush current.

The target turn-on phase as described above can be determined by calculating a voltage at the intersection Q1 by displacing the characteristic line Lm in parallel to the direction along the time axis. When the target turn-on phase has been determined, a target closing time point can be determined as the intersection Q2 that is corresponding to the intersection Q1 in this case. As compared to the intersection Q1 illustrated in FIG. 11, the intersection Q1 in FIG. 15 is set at a point where the voltage value is closer to the maximum value of the absolute value of the interelectrode voltage ΔV.

Even when variations in the rate of decrease of dielectric strength (RDDS) of the circuit breaking unit 3 are taken into account, the target turn-on phase can still be determined in the same manner as in the first embodiment. In a case where the phase modifier is the reactor 35, the target turn-on voltage, at which the absolute value of the turn-on voltage is maximized, is obtained as a phase at which the minimum turn-on voltage value within the variation range of the characteristic line Lm is maximized.

More specifically, when the characteristic line Lm is given as the average, a specific variation range is defined. Thus, how the turn-on voltage varies within the variation range can be calculated specifically. The characteristic line Lm is displaced in parallel to the direction along the time axis to calculate how the minimum turn-on voltage value changes, and thereby the characteristic line Lm on which the minimum turn-on voltage value is maximized can be derived. At a phase at the intersection Q1 between the interelectrode voltage ΔV and the characteristic line Lm derived as described above, the minimum turn-on voltage value is maximized.

Other configuration and operation according to the present embodiment are identical to those according to the first embodiment. According to the present embodiment, the power switching control device 1 estimates the interelectrode voltage ΔV of the circuit breaking unit 3 after the switch 5 is turned on and before the circuit breaking unit 3 is turned on, and then determines the target closing time point, which gives the target turn-on phase for the circuit breaking unit 3 that is set in accordance with the reactor 35. Thus, the power switching control device 1 is capable of further suppressing a surge voltage or an inrush current at the time when the circuit breaking unit 3 is turned on.

The configurations described in the above embodiments are only examples of the content of the present invention. The configurations can be combined with other well-known techniques, and a part of each configuration can be omitted or modified without departing from the scope of the present invention.

REFERENCE SIGNS LIST

1 power switching control device, 2 circuit breaker, 3 circuit breaking unit, 3*a* movable main contact, 3*b* fixed main contact, 3*c* movable arc contact, 3*d* fixed arc contact, 4 resistor, 5 switch, 5*a* movable resistance contact, 5*b* fixed resistance contact, 7 busbar, 8 power supply, 9 coil spring, 10 capacitor, 11 voltage measurement unit, 12 interelectrode-voltage calculation unit, 13 target closing time-point determination unit, 14 current measurement unit, 15 turn-on time-point detection unit, 16 closing-time estimation unit, 17 closing control unit, 18 instrument transformer, 19 instrument current transformer, 20 arc-extinguishing chamber, 21 metal container, 22 operation mechanism, 25 power transmission line, 30*a* CPU, 30*b* memory, 30*c* input/output interface, reactor.

The invention claimed is:

1. A power switching control device to control opening and closing of a circuit breaker including a circuit breaking unit, a resistor connected in parallel to the circuit breaking unit, and a switch connected in parallel to the circuit breaking unit and connected in series to the resistor to be turned on prior to the circuit breaking unit, one end of the circuit breaking unit being connected to an AC power supply and the other end of the circuit breaking unit being connected to a phase modifier, the power switching control device comprising:

a processor to execute a program, and a memory to store the program which, when executed by the processor, performs processes of, measuring a power-supply-side voltage of the circuit breaker;

calculating a current that flows through the resistor after the switch is turned on and before the circuit breaking unit is turned on by using a measurement value of the power-supply-side voltage, a resistance value of the resistor, and an impedance of the phase modifier, and calculating an interelectrode voltage of the circuit breaking unit after the switch is turned on and before the circuit breaking unit is turned on by using the current and the resistance value;

determining a target closing time point for the circuit breaking unit so that a target turn-on phase for the circuit breaking unit becomes a phase that is set in accordance with the phase modifier, by using an interelectrode rate of decrease of dielectric strength and the interelectrode voltage of the circuit breaking unit; and outputting a control signal to the circuit breaker such that the circuit breaking unit is closed at the target closing time point.

2. The power switching control device according to claim 1, wherein the phase modifier is a capacitor, and the target turn-on phase is a phase at which an absolute value of the interelectrode voltage at a time when the circuit breaking unit is turned on is minimized.

3. The power switching control device according to claim 1, wherein the phase modifier is a reactor, and the target turn-on phase is a phase at which an absolute value of the interelectrode voltage at a time when the circuit breaking unit is turned on is maximized.

* * * * *